US011118807B2

(12) United States Patent
Carton et al.

(10) Patent No.: US 11,118,807 B2
(45) Date of Patent: Sep. 14, 2021

(54) DOOR ASSEMBLY, AIR HANDLING UNIT COMPRISING SUCH A DOOR ASSEMBLY, AND METHOD FOR MANUFACTURING SUCH A DOOR ASSEMBLY

(71) Applicants: Carrier Corporation, Palm Beach Gardens, FL (US); Thomas Carton, Eloise (FR)

(72) Inventors: Thomas Carton, Eloise (FR); Samuel Duchet, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 382 days.

(21) Appl. No.: 16/080,244

(22) PCT Filed: Mar. 4, 2016

(86) PCT No.: PCT/IB2016/000363

§ 371 (c)(1),
(2) Date: Aug. 27, 2018

(87) PCT Pub. No.: WO2017/149341

PCT Pub. Date: Sep. 8, 2017

(65) Prior Publication Data

US 2019/0049145 A1 Feb. 14, 2019

(51) Int. Cl.
*F24F 13/20* (2006.01)
*E06B 1/12* (2006.01)
(Continued)

(52) U.S. Cl.
CPC ..... *F24F 13/20* (2013.01); *E06B 1/12* (2013.01); *E06B 3/12* (2013.01); *E06B 3/20* (2013.01);
(Continued)

(58) Field of Classification Search
CPC .... F24F 13/20; E06B 1/12; E06B 3/12; E06B 3/20; E06B 3/275; E06B 3/76; E06B 3/78
(Continued)

(56) References Cited

U.S. PATENT DOCUMENTS 2,922,202 A * 1/1960 Kodaras ..... E06B 7/18 49/401
3,217,921 A 11/1965 Frehse
(Continued)

FOREIGN PATENT DOCUMENTS

CN 202164985 U 3/2012
CN 203441269 U 2/2014
(Continued)

OTHER PUBLICATIONS

International Search Report and Written Opinion for application PCT/162016/000363, dated Dec. 12, 2016, 10 pages.
(Continued)

*Primary Examiner* — Vivek K Shirsat
(74) *Attorney, Agent, or Firm* — Cantor Colburn LLP

(57) ABSTRACT

This door assembly (29) comprises a frame (31), extending along a frame plane (P1) and comprising: at least one frame beam (35) defining a frame axis (X35) along the frame plane, the frame beam comprising a main body (39) elongated along the frame axis and having a substantially constant cross-section (S39) along said frame axis, the main body comprising a beveled portion (55) inclined relative to the frame plane; and a swing door (33), pivotably secured to the frame between an opened position and a closed position, said swing door comprising at least one edge beam (63) comprising a main body (139) elongated along an edge axis (X63) of the edge beam and having a substantially constant cross-section (S139) along said edge axis, the main body comprising a beveled portion (155) which is brought to rest
(Continued)

against the beveled portion of the frame beam when the swing door is brought to the closed position, wherein the cross-section (S39) of the main body (39) of the frame beam (35) is identical to the cross-section (S139) of the main body (139) of the edge beam (63).

11 Claims, 5 Drawing Sheets

(51) Int. Cl.

| | |
|---|---|
| ***E06B 3/12*** | (2006.01) |
| ***E06B 3/20*** | (2006.01) |
| ***E06B 3/72*** | (2006.01) |
| ***E06B 3/76*** | (2006.01) |
| ***E06B 3/78*** | (2006.01) |
| ***E06B 3/70*** | (2006.01) |

(52) U.S. Cl.
CPC ..... *E06B 3/725* (2013.01); *E06B 3/76* (2013.01); *E06B 3/78* (2013.01); *E06B 2003/709* (2013.01); *E06B 2003/7032* (2013.01)

(58) Field of Classification Search
USPC ..... 454/276, 275; 49/401, 502
See application file for complete search history.

(56) References Cited

U.S. PATENT DOCUMENTS

| | | | | |
|---|---|---|---|---|
| 3,364,298 | A | 1/1968 | Peters | |
| 3,403,476 | A * | 10/1968 | Ciucani | E06B 3/16 49/401 |
| 3,555,734 | A | 1/1971 | Hirtle et al. | |
| 4,018,475 | A | 4/1977 | Richtermeier | |
| 4,607,457 | A | 8/1986 | Shewchuk | |
| 5,158,043 | A | 10/1992 | Emsbo | |
| 5,711,706 | A | 1/1998 | Griffin et al. | |
| 5,974,757 | A | 11/1999 | Whitney et al. | |
| 6,185,871 | B1 | 2/2001 | Wang | |
| 6,745,515 | B1 | 6/2004 | Chen | |
| 6,771,181 | B1 | 8/2004 | Hughen, Jr. | |
| 6,974,383 | B2 | 12/2005 | Lewis et al. | |
| 7,430,835 | B1 | 10/2008 | Larson | |
| 8,246,703 | B2 | 8/2012 | Bordin | |
| 2004/0068939 | A1 * | 4/2004 | Beser | F24F 13/20 52/79.9 |
| 2006/0101736 | A1 | 5/2006 | Okugawa | |
| 2007/0044383 | A1 | 3/2007 | Marshall | |
| 2007/0157585 | A1 | 7/2007 | Lee | |
| 2011/0105011 | A1 | 5/2011 | Dubensky et al. | |
| 2011/0291533 | A1 | 12/2011 | McFarland | |
| 2014/0115958 | A1 | 5/2014 | Helene et al. | |

FOREIGN PATENT DOCUMENTS

| | | | |
|---|---|---|---|
| CN | 203489443 | U | 3/2014 |
| CN | 203684931 | U | 7/2014 |
| DE | 9303926 | U1 | 5/1993 |
| DE | 19652732 | A1 | 6/1998 |
| ES | 1096033 | U | 12/2013 |
| GB | 1229998 | A | 4/1971 |
| GB | 2464089 | A | 4/2010 |
| JP | H08199925 | A | 8/1996 |
| JP | H09317340 | A | 12/1997 |
| KR | 20070068504 | A | 7/2007 |

OTHER PUBLICATIONS

Chinese First Office Action CN 201680083590.6, dated Nov. 14, 2019, 9 pages.

* cited by examiner

DOOR ASSEMBLY, AIR HANDLING UNIT COMPRISING SUCH A DOOR ASSEMBLY, AND METHOD FOR MANUFACTURING SUCH A DOOR ASSEMBLY

The present invention concerns a door assembly, an air handling unit comprising such a door assembly, and a method for manufacturing such a door assembly.

It is known to implement air handling units on buildings, especially office buildings or supermarkets, for treating the air contained inside the building. Such air handling units usually have inlet and outlet openings, for the air to be circulated through the unit, and a plurality of components, each relative to a function for treating the air, such as circulating, filtering, depolluting, humidifying, drying, heating, cooling, or the like. These components are enclosed inside a structural frame, supporting a housing made of flat insulating panels, forming a protective thermal barrier of the air handling unit. Each panel comprises an insulating core material, for example a glass-wool layer, interposed between two metallic walls. Usually, some of the panels of the unit are removable, or the unit is provided with one or more doors with a handle and hinges or the like, so that the inside of the unit may be accessed for maintenance of the internal components contained within.

However, the door often constitutes an expensive part of the housing of the unit, since it has to be manufactured and mounted so as to prevent both air and heat leakage through said door.

U.S. Pat. No. 4,607,457 discloses a door assembly for a building, said door assembly including an insulating door jamb and a swing door, including an internal insulating material, mounted to the door jamb. The swing door has a tapered edge corresponding with a tapered section of the jamb, so that the tapered edge of the door and the tapered section of the jamb are in planar contact when the door is closed. A sealing strip is provided at the edge of the door for a better insulation.

However, this jamb and this swing door require a costly manufacturing process for ensuring planar contact between the tapered surfaces, while a precise assembly thereof may be difficult.

The aim of the invention is to provide a new door assembly which is especially easy and inexpensive to manufacture and assemble, while providing an efficient thermal insulation and preventing air leakage.

To this end, the invention concerns a door assembly according to claim 1.

Thanks to the invention, the frame beam and the edge beam may be manufactured with the same machine, or at least in a similar machine, so that the cost of said beams is relatively low. The door assembly is still efficiently insulating and leak proof since the frame beam and edge beam have appropriate beveled portions for insulating when the swing door is in the closed position. Lastly, since the frame beam and the edge beam have main bodies of identical cross-sections, they are easy to position relative to each other when the door assembly is implemented in an air handling unit.

Further optional and advantageous aspects of the invention are defined in claims 2 to 13.

The invention further relates to an air handling unit according to claim 14 and to a method for manufacturing a door assembly according to claim 15.

The invention will now be explained in reference to the annexed drawings, as an illustrative example. In the annexed drawings.

Figure 1:
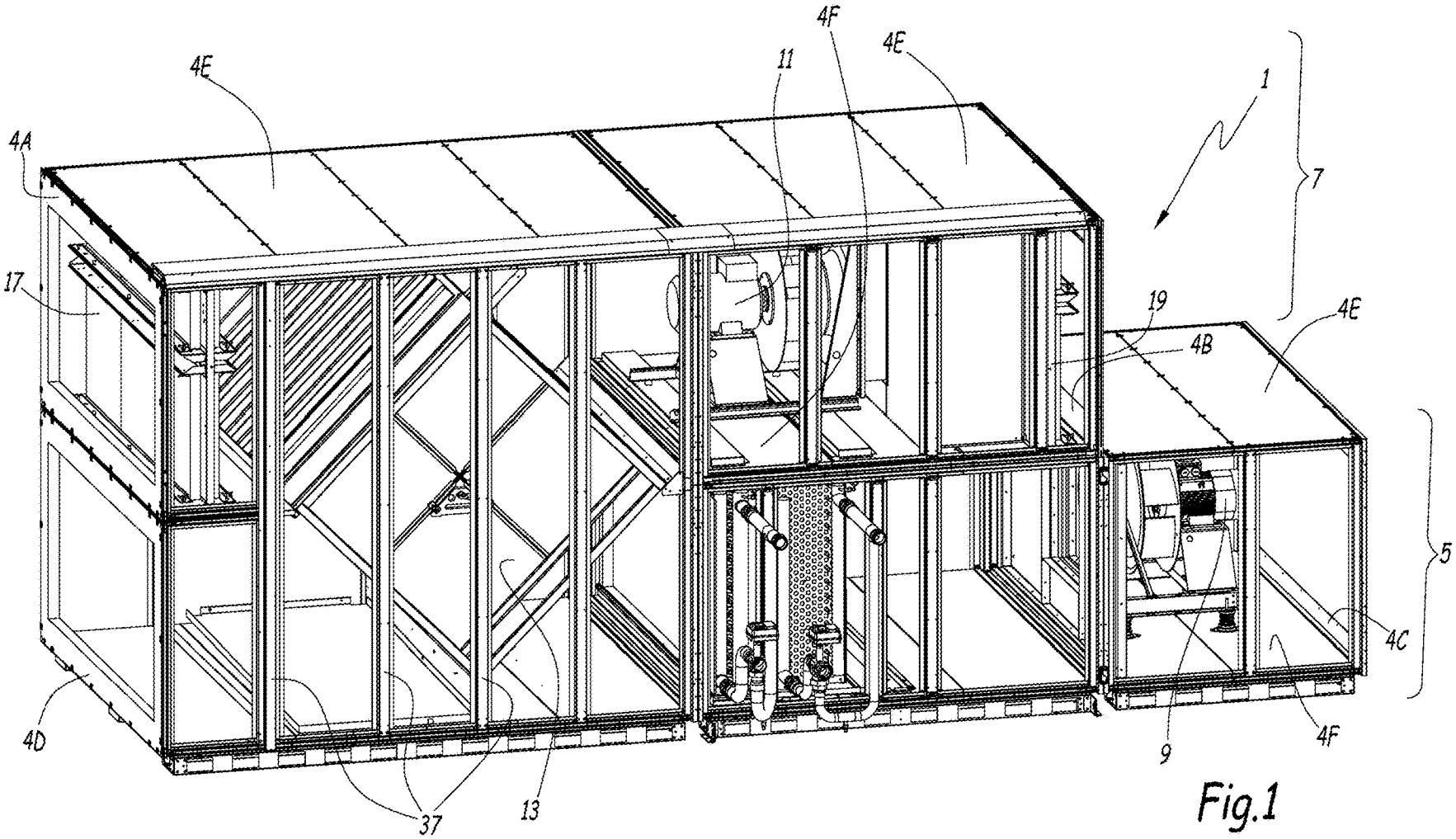
FIG. 1 is a perspective view of an air handling unit according to the invention.

FIG. 1 shows an air handling unit 1 which comprises a structural frame including supporting beams 37, onto which are secured flat insulating panels 4A, 4B, 4C, 4D, 4E and 4F, of substantially rectangular shape, constituting a housing of the unit 1. Some of these panels are omitted from FIG. 1 for making the inside of the housing visible. Some other panels 4A, 4B, 4C and 4D constitute inlet and outlet panels. Other panels constitute horizontal roof panels 4E and horizontal floor panels 4F.

The air handling unit 1 comprises two levels, namely a first level 5 and a second level 7 superposed over said first level 5. Level 7 is delimited at its ends by panels 4A and 4B, laterally by successive panels not shown in FIG. 1, at the top by roof panels 4E and at the bottom by floor panels 4F. Similarly, level 7 is delimited at its ends by panel 4C and 4D, panel 4D being positioned in the same plane as panel 4A, while panel 4C is positioned in a plane parallel to the plane of panel 4B, at a distance of panel 4C. The horizontal distance between panels 4B and 4C is covered by two roof panels 4E covering the top of level 5 between panel 4B and panel 4C. Successive lateral panels, not shown in FIG. 1, cover level 5 laterally, while the bottom of level 5 is delimited by floor panels 4F.

The air handling unit 1 includes several components, some of which are illustrated in FIG. 1. Among these components, this air handling unit 1 comprises a fan motor assembly 9 enclosed inside the housing at level 5, at the vicinity of panel 4C. The air handling unit 1 further comprises a fan motor assembly 11, enclosed within level 7 between panels 4A and 4B. The air handling unit 1 also has an air heat exchanger 13 provided across levels 5 and 7, between panel 4A and the fan motor assembly 11, and between panel 4D and the fan motor assembly 9. Depending on the application, various other components may be provided to the air handling unit 1.

Figure 2:
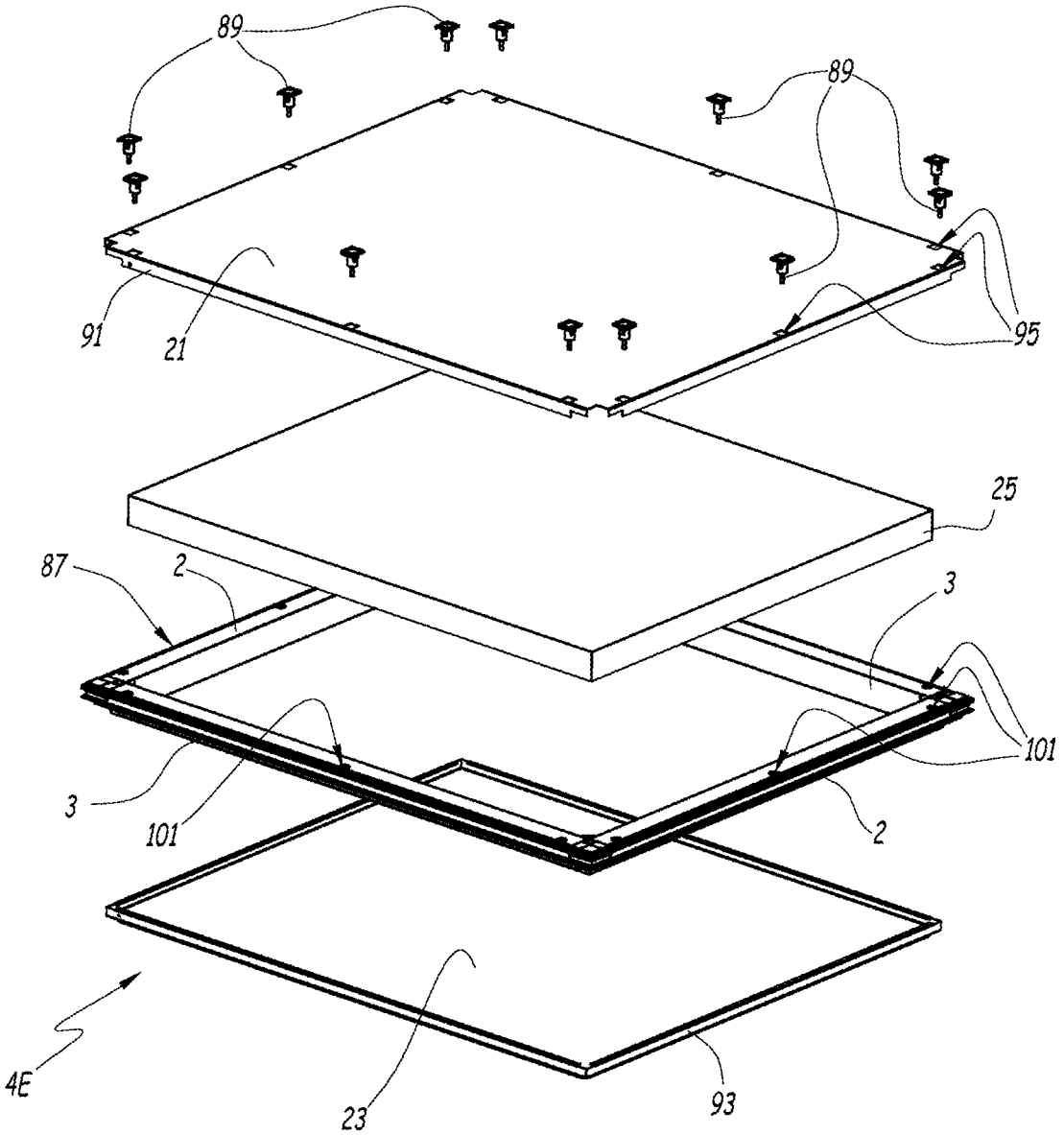
FIG. 2 is a perspective exploded view of an insulating panel of the air handling unit of FIG. 1.

As illustrated in FIG. 2, each panel 4A to 4F comprises a first outer wall 21, a second inner wall 23, a layer of insulating material 25, a peripheral frame 87 and a plurality of fastening systems 89. The walls 21 and 23 as well the layer 25 are parallel to each other The wall 21 is is positioned on the outside of the air handling unit 1. The wall 23 is positioned on the inside of the air handling unit 1. Each fastening system 89 preferably comprises a bushing and a screw inserted through said bushing.

The wall 21 is provided with four edge flanges 91 oriented towards the wall 23, while said and wall 23 comprises four edge flanges 93 oriented towards wall 21.

Furthermore, the outer wall 21 comprises a plurality of through holes 95, positioned along its periphery and configured to receive the fastening systems 89.

The walls 21 and 23 are made of a substantially rigid material, such as aluminum alloy or any other metallic material, or alternatively a plastic material.

The layer 25 is arranged between the walls 21 and 23 for limiting heat transfer through the panel 4A to 4F. Thus, the assembled panels 4A to 4F form a thermal barrier intended to limit heat loss between the inside and the outside of the air handling unit 1. For example, layer 25 comprises a glass-wool material, or any other suitable material.

The peripheral frame 87 comprises four structural beams 2 and 3, the beams 2 being arranged longitudinally, and the beams 3 transversally, in a rectangular shape surrounding the layer 25. The four beams 2 and 3 preferably have an identical cross-section. The frame 87 is interposed between the walls 21 and 23 and allows mounting of the considered panel 4A to 4F onto another panel of the same type for building the air handling unit 1.

Each beam 2 and 3 comprises retaining holes 101 aligned with the through hole 95 so that each of the fastening system 89 may be introduced into a pair of aligned through hole 95 and retaining hole 101. More precisely, each beam 2 and 3 is preferably an extruded part, including an outer portion 103, an inner portion 105, and an intermediate portion 107, as visible in FIG. 4. The portions 103, 105 and 107 are arranged parallel to each other and to the walls 21 and 23. The outer wall 21 is supported by the outer portion 103, with the edge flange 91 resting against an edge portion 109 of the beam 2 or 3. The edge portion 109 links the outer portion 103 to the intermediate portion 107. The inner wall 23 is supported by the inner portion 105, with the edge flange 93 resting against a staggered edge portion 111 of the beam 2 or 3, linking the inner portion 105 to the intermediate portion 107.

In particular, each retaining hole 101 is provided through the outer portion 103, while intermediate holes are provided through the intermediate portion 107, in alignment with the retaining holes 101.

Figure 3:
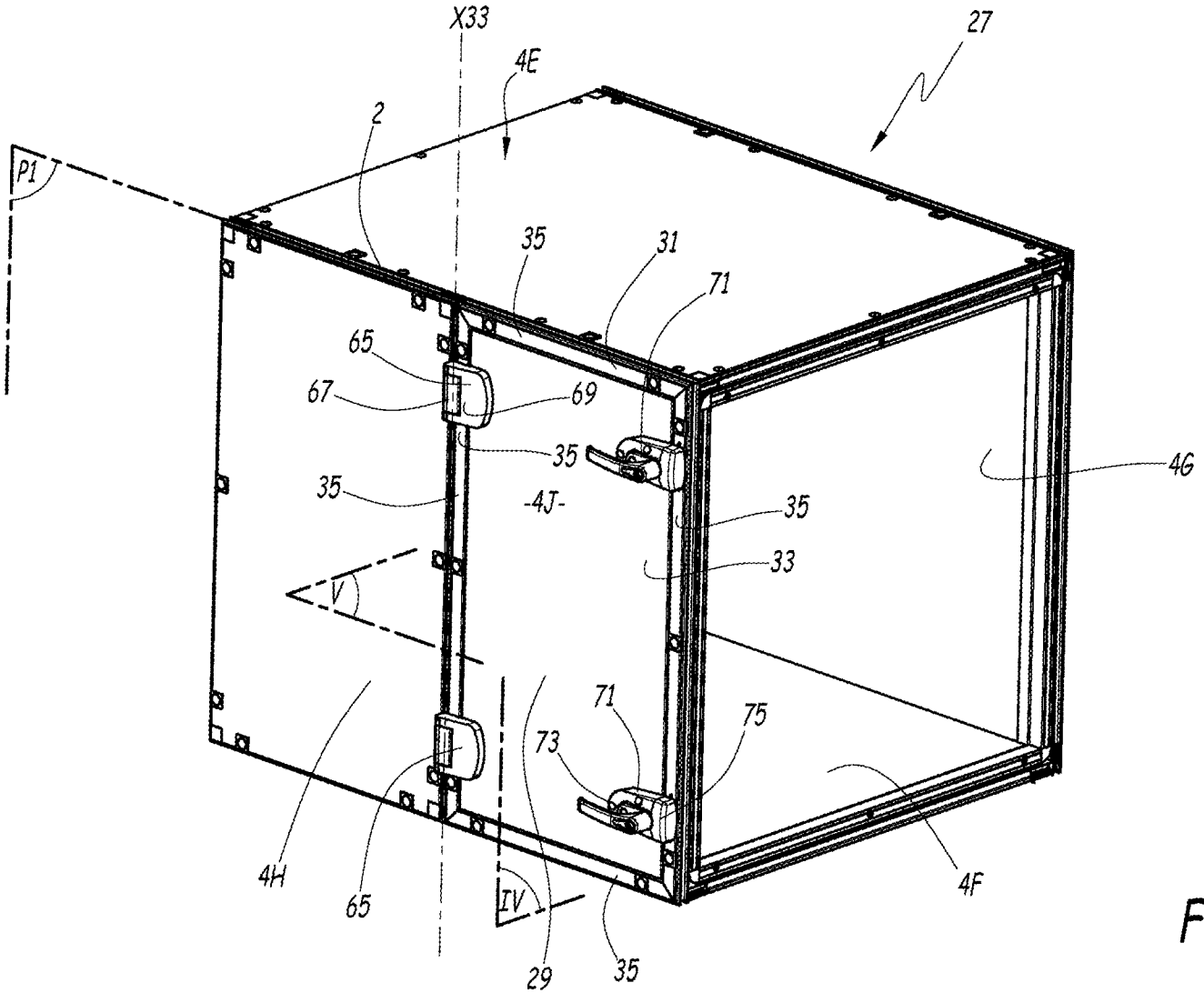
FIG. 3 is a perspective view of a module of an air handling unit provided with a door assembly according to the invention.

The air handling unit 1 may be divided into separated modules, such as an exemplary module 27 depicted in FIG. 3, including one roof panel 4E, one floor panel 4F, a back panel 4G and a front panel 4H, all of these panels 4E to 4H comprising the same elements as the ones recited for panel 4E depicted in FIG. 2.

The module 27 further includes a door assembly 29 comprising a frame 31 and a swing door 33.

Figure 4:
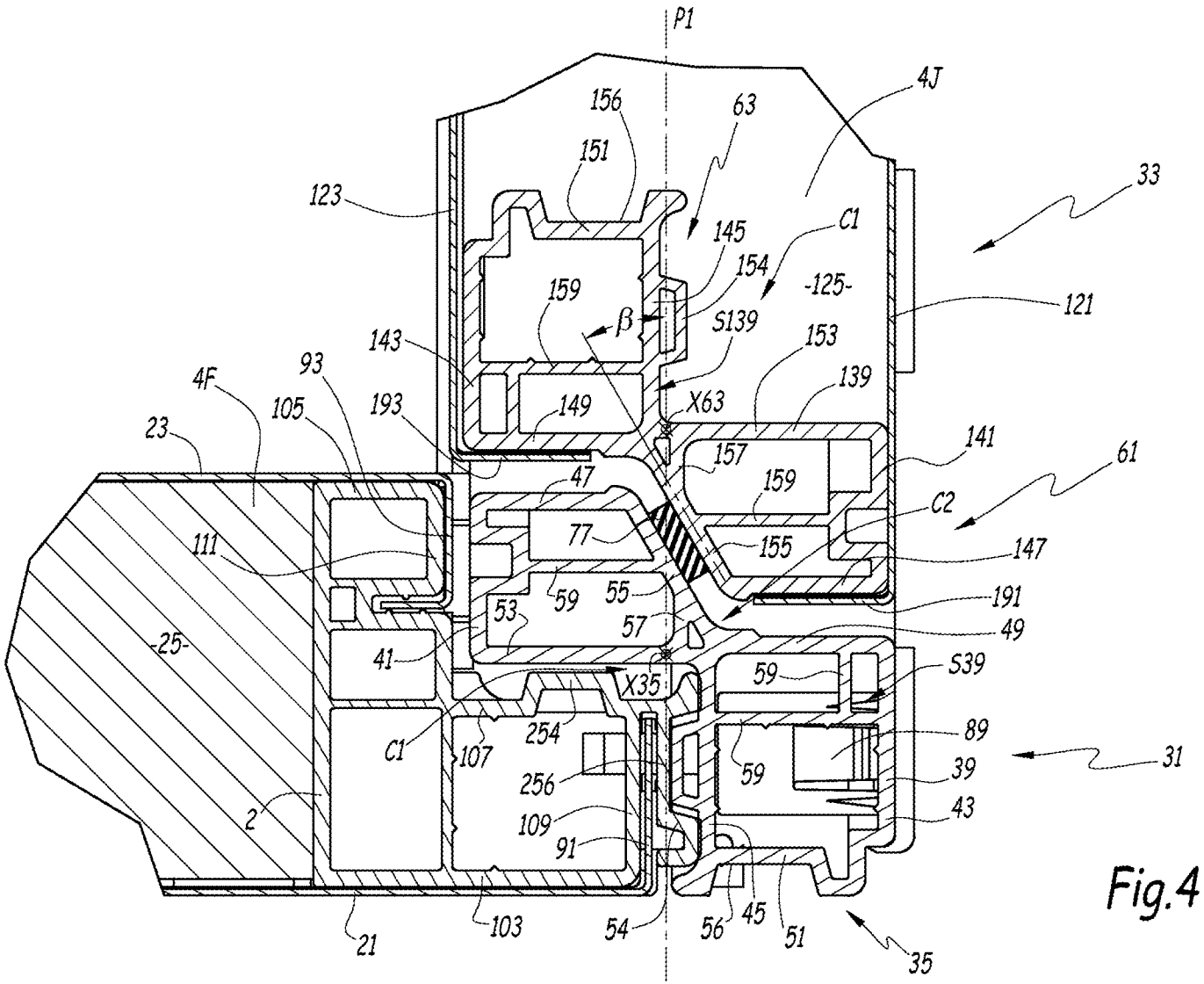
FIGS. 4 and 5 are cross-sectional views taken along planes IV and V of FIG. 3, respectively.

The frame is provided with four frame beams 35 arranged as a rectangle along a similar plane as panel 4H. Thus, the frame beams 35 extend in a frame plane P1 substantially vertical and parallel to panel 4H. The frame beams 35 surround the swing door 33. Two of the frame beams 35 are horizontal, namely the top beam 35 secured to a structural beam 2 of panel 4E and the bottom frame beam 35 secured to a structural beam 2 of panel 4F, as depicted in FIG. 4. The two other frame beams 35 are arranged vertically, linking together the top and bottom frame beams 35. The vertical frame beams 35 are each secured to a supporting beam 37, one being visible in FIG. 5, said supporting beam 37 being arranged vertically within the module 27.

As depicted in FIG. 4, each of the frame beams 35 defines a longitudinal frame axis X35 along the frame plane P1, the axis X35 being oriented along the corresponding beam 35. Each of the beams 35 is essentially formed by an elongated main body 39 along the frame axis X35. Thus, the beams 35 each form a profile that may be manufactured by extrusion of said main body 39 along the frame axis X35.

As shown in FIG. 4, a cross-section S39 of the main body 39 is depicted. This cross-section S39 is taken in the plane IV, perpendicular to the frame axis X35. The main body 39 has a substantially constant cross-section S39 along axis X35. By "substantially constant", it is meant that the cross-section S39 of the body 39 is identical from one end to another end of said body 39 along axis X35, except for:

- any carving or hole that could be provided into the body 39, such as holes for accommodating fastening systems 89, or local deformation of said body 39, and
- any part of the beam 35 which could be secured to the body 39, by fastening, welding, gluing or the like.

The main body 39, comprises three portions which extend parallel to the frame plane P1, namely an outward side portion 41, an inward side portion 43 and an intermediate portion 45. The outward side portion 41 and the inward side portion 43 are opposed to each other and staggered, while the intermediate portion 45 extends between the outward side portion 41 and the inward side portion 43, alongside the inward side portion 43. The intermediate portion 45 and the inward side portion 43 have approximately the same length measured along plane P1.

The main body 39 further comprises portions which are perpendicular to the frame plane P1, namely an outward edging portion 47, an inward edging portion 49, a backing portion 51 and a central portion 53. The outward edging portion 47 and the inward edging portion 49 extend parallel to each other, the outward edging portion 47 extending from the outward side portion 41 towards the inward edging portion 49, while the inward edging portion 49 extends from the inward side portion 43 towards the outward edging portion 47. Thus, the edging portions 47 and 49 are staggered.

The edging portions 47 and 49 are linked by a beveled portion 55, which extends along an inclined direction relative to the frame plane P1 at an angle β. Said angle β is preferably equal to 30°, but could be comprised for example between 10° and 60°. Thus, the beveled portion 55 is located between the outward side portion 41 and the inward side portion 43. The edging portions 47 and 49 and the beveled portion 55 form a continuous edge of the main body 39. In other words, portion 55 is extending in a diagonal direction compared to the edging portions 47 and 49 and to the side portions 41 and 43. The central portion 53 extends from the outward side portion 41 to the inward edging portion 49 and the inwards side of the beveled portion 55.

The portions 45, 49, 53 and 55 are connected together at a junction point 57 at a substantially central location of the main body 39. The intermediate portion 45 and the inward edging portion 49 extend from said junction point 57, located at an inward side of the beveled portion 55, said inward side being oriented towards the inward side portions 43. The outward side portion 41 extends between portion 47 and portion 53, so that portions 41, 47, 53 and 55 form a substantially trapezoidal shape. The central portion 53 is substantially aligned or slightly staggered with the inward edging portion 49. The backing portion 51 extends parallel to the inward edging portion 49 so as to form a substantially rectangular shape with portions 43, 45 and 49. The outward edging portion 47 extends from an outward side of the beveled portion 55, said outward side being opposed to the junction point 57.

The intermediate portion 45 and the central portion 53 delimit an opened cavity C1 of the main body 39, while the beveled portion 55 and the inward edging portion 49 delimit an opposite open cavity C2 of the main body 39. More precisely, the second opened cavity C2 is opposite to the first opened cavity C1 relative to the junction point 57.

As a summary, the main body 39 comprises a first trapezoidal part, including portions 41, 47, 53 and 55, and a second rectangular part, including portions 43, 45, 49 and 51, these two parts being connected at the junction point 57.

The main body 39 further comprises reinforcing bulkheads 59, some of them extending along plane P1 and some of them being perpendicular to said plane P1, within the trapezoidal part and within the rectangular part.

Fastening systems 89 are engaged through the inward side portion 43 and through the intermediate portion 45 of the frame beams 35 for securing said frame beam 35 to their respective support. In FIG. 4, the support is the beam 2 of panel 4F for the bottom horizontal beam 35, whereas according to FIG. 5, the support is the supporting beam 37 for one of the vertical beams 35. At least a part of the beam 2 or 37 is positioned in the opened cavity C1 formed between the central portion 53 and the intermediate portion 45.

The main body 39 has a primary connection portion 54, protruding from the intermediate portion 45 in a direction opposite to the inward side portion 43, and has a secondary connection portion 56, protruding from the backing portion 51, in a direction opposite the beveled portion 55. The secondary connection portion 56 has a shape corresponding, in other words matching, with the shape of the primary connection portion 54, said shape being a trapezoidal shape in the illustrated example. In particular, the portion 54 has a protruding shape, or male shape, whereas the portion 56 has a recessed shape or female shape, which could accommodate the shape of portion 54.

As depicted in FIG. 4, the bottom frame beam 35 is secured to the beam 2 of panel 4F by means of the primary connection portion 54, inserted into a secondary connection portion 256 of beam 2. The shape of the portion 256 and portion 54 are corresponding, in other words matching. The portion 256 protrudes from the edge portion 109 of beam 2 and has a shape identical to the secondary portion 56.

In a non-illustrated embodiment of the invention, the bottom frame beam 35 is secured to the beam 2 of panel 4F by means of the secondary connection portion 56, inserted into a primary connection portion 254 of beam 2, visible in FIG. 4. The shape of the portion 254 corresponds to the shape of portion 56. Portion 254 protrudes from the intermediate portion 107 of beam 2 and has a shape identical to the secondary portion 56.

Being provided with both primary connection portion 54 and secondary connection portion 56, the main body 39 is both adaptable to various configurations of the air handling unit 1 and easy to secure to a support.

Figure 5:
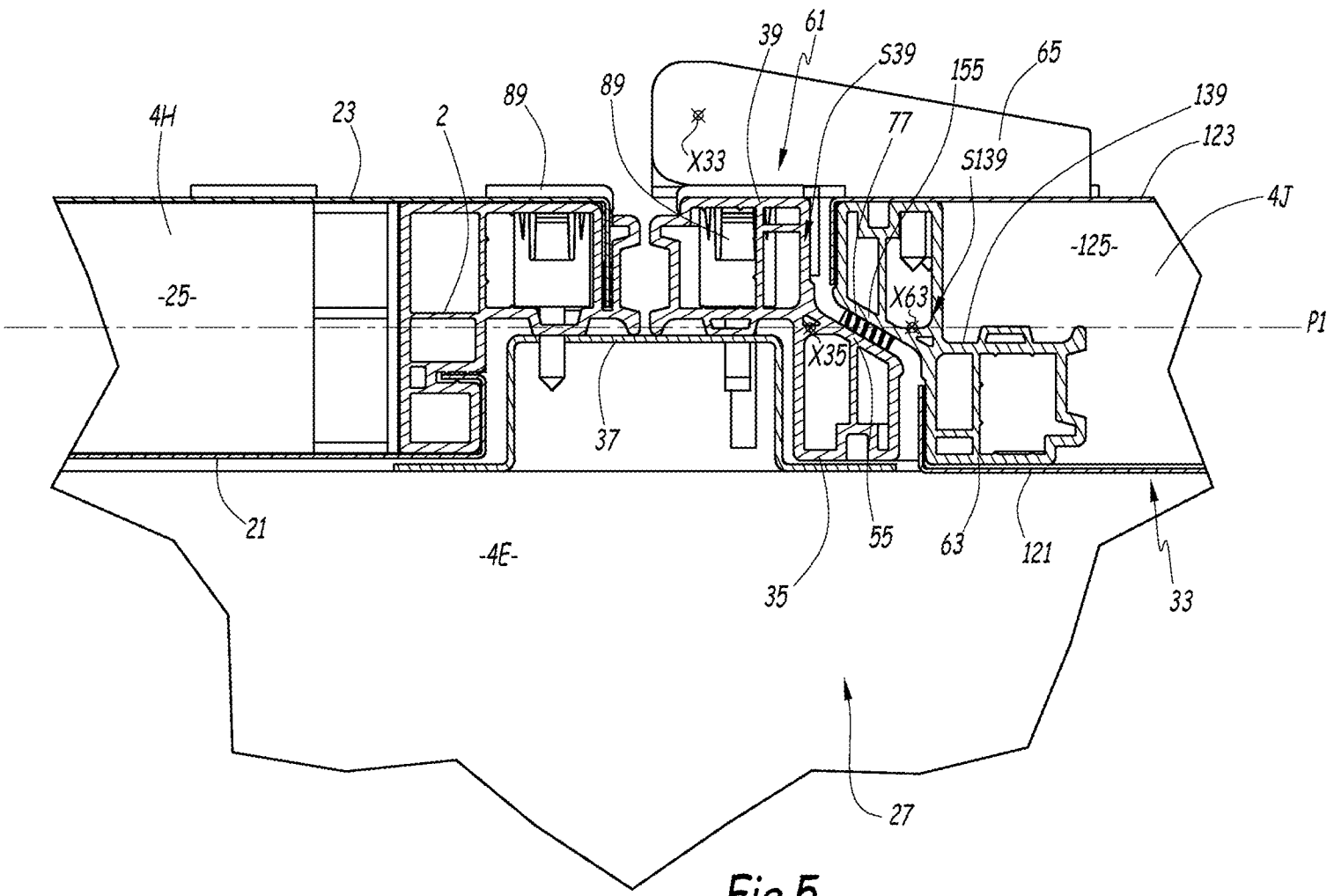

As depicted in FIG. 5, the two vertical frame beams 35 are secured to their respective adjacent supporting beams 37 by means of fastening systems 89, engaged through the inward side portion 43, through the intermediate portion 45 and trough the beam 37. In this case, the frame beams 35 rest on a flat surface of their respective supporting beams 37. The panel 4H adjacent to the beam 35 is secured to the same supporting beam 37 than said beam 35, with fastening systems 89.

The swing door 33 is secured to the frame 31 so that the swing door 33 can be pivoted around a vertical axis X33 visible in FIG. 3 relative to the frame 31. The door 33 can be rotated between an opened position, not illustrated, in which a main plane of the door is vertical and inclined relative to plane P1 in a top view, and a closed position where the plane of the door 33 extends along plane P1, as illustrated in FIGS. 3 to 5. The door is pivotably secured to the frame 31 by means of two hinges 65, or a different suitable number of hinges. Each of the hinges 65 comprises a supporting part 67 secured to the inward side portion 43 of one of the vertical frame beams 35. Each hinge 65 also comprises a swing part 69 pivotably secured to the supporting part 67 around axis X33, and also secured to the swing door 33; as shown in FIG. 3. The door assembly 29 is also provided with locking systems 71, each of which includes a door handle part 73 secured onto the swing door 33 and a locking strike 75 secured to the inward side portion 43 of a frame beam 35 opposed to the frame beam 35 to which the hinges 65 are secured. The door handle part 73 has a latch (non-illustrated) that can be locked to the locking strike 75 for locking the swing door relative to the frame 31 in the closed position.

The swing door 33 comprises a rectangular panel 4J, to which the swing parts 69 of the hinges 65 are secured. The panel 4J has a similar structure than the panel 4E illustrated in FIG. 2 and comprises in particular an outer wall 121, and inner wall 123, and a layer 125 of thermal insulating material interposed between the walls 121 and 123. The swing door 33 comprises, instead of a peripheral frame 87, a peripheral frame 61 comprising four edge beams 63 arranged as a rectangle, similarly to the beams 2 and 3. Thus, the edge beams 63 are secured to four edges of the rectangular shaped panel 4J. Each of said edge beams 63 defines an edge axis X63 visible in FIG. 4, and extending along plane P1 when the swing door 33 is in a closed position relative to the frame 31. In other words, the axes X63 of the edge beams 63 are extending along the plane of the door, parallel to the door walls 121 and 123.

The edge beams 63 constitute the outline of the swing door 33 which matches with the frame beams 35, forming an inner outline of the frame 31. Thus, the four edge beams 63 correspond to the four frame beams 35 respectively, and are arranged as a corresponding rectangle. The frame beams 35 and their respective adjacent edge beams 63 extend alongside in a parallel position when the door is in the closed position.

Each of the edge beams 63 comprises a main body 139, as visible in FIG. 4, said main body 135 being elongated along the edge axis X63 of the edge beam 63. A cross-section S139 of the main body 139 is shown in FIG. 4, taken in plane IV, which is perpendicular to the edge axis X63. Said cross-section S139 is substantially constant along axis X63. The term "substantially" refers to the same notion as the term "substantially" used for the cross-section S39 of the main body 39 above.

The cross-section S139 of the main body 139 is identical to the cross-section S39 of the main body 39 of the frame beam 35. Thus, in the illustrated example, the main body 139 has, identically to the main body 39: an outward side portion 141, an inward side portion 143, and intermediate portion 145, an outward edging portion 147, an inward edging portion 149, a backing portion 151, a central portion 153, a beveled portion 155, a junction point 157, reinforcing bulkheads 159, a primary connection portion 154 and a secondary connection portion 156. As a consequence, the main bodies 39 and 139 of the frame beam 35 and of the edge beam 63, respectively, can be made by extrusion of a suitable material, such as plastic material or an aluminum alloy, from a common extruder. In other words, the beams 35 and 63 can be made in the same machine, or machines with similar functions and settings. More precisely, the machine(s) may produce an elongated body with the appropriate cross-section, and said elongated body may be cut at the appropriate length for forming either a frame beam 35 or an edge beam 63.

As shown in FIG. 4, when the door 33 is in the closed position, the body 139 is arranged in a rotated position around axis X63 relative to the main body 39 of the adjacent frame beam 35.

The beveled portion 155 of the main body 139 of each of the edge beams 63 is brought to rest against the corresponding beveled portion of one of the frame beams 35, as visible in FIGS. 4 and 5, when the swing door 33 is brought to the closed position. Thus, in the closed position, the portions 55 and 155 of two corresponding beams 35 and 63 are substantially parallel and facing each other. A sealing gasket 77 is provided on the surface of the beveled portions 55, so as to form a closed rectangle all along the frame 31. Thus, the beveled portions 155 are put into sealing contact with said sealing gasket 77, ensuring that, when the door 33 is in closed position, substantially no air may leak through the door assembly 29, during normal use of the air handling unit 1. Alternatively, the sealing gasket 77 is provided on the surface of the beveled portion 155 instead of beveled portion 55, so as to be interposed between the beveled portions 55 and 155 when the door 33 is in the closed position. Alternatively, two sealing gaskets are provided, one of them being on the surface of the beveled portions 55, and the other being provided on the surface of the beveled portions 155. In any case, the position of the beveled portions 55 and 155 relative to the plane P1 ensure longevity of the sealing gasket 77 despite potential high usage of the door assembly 29.

The main body 139 being rotated at a 180° relative to the main body 39, the inward side portion 43 is brought in alignment with the outward side portion 141, while the outward side portion 41 is brought in alignment with the inward side portion 43, when the swing door 33 is brought to the closed position as depicted in FIG. 4. The inward edging portion 49 is brought parallel and facing to the outward edging portion 147 while the outward edging portion 47 is brought parallel and facing to the inward edging portion 149, when the swing door 33 is brought to the closed position. Thus, the frame 31 and the edge beams 63 extend along the same plane P1 when the swing door 33 is in the closed position.

The respective outward edging portion 147 of each edge beam 63 is brought into the second cavity C2 of the corresponding frame beam 35 when the door 33 is brought to the closed position. Similarly, the respective outward edging portion 47 of each frame beam 35 is brought into the second cavity C2 of the corresponding edge beam 63 when the door 33 is brought to the closed position.

The walls 121 and 123 of the swing door 33 are respectively in planar contact with the side portion 141 and the side portion 143 of the edge beams 63. In addition, an edge flange 191 of wall 121 is in planar contact with the edging portion 147 while an edge flange 193 of wall 123 is in planar contact with the edging portion 149. In other words, the walls 121 and 123 curve around the edge beams 63. For that purpose, the edging portions 47, 49, 147 and 149 are provided with a recess extending from the respective side portions 41, 43, 141, 143 to an intermediate location close to the beveled portion 55 or 155. The edge flanges 191 and 193 are arranged in the recesses of the edging portions 147 and 149, while the edging portions 47 and 49 are left free.

The aforementioned embodiments and features of the invention may be combined for generating further embodiments of the invention.

The invention claimed is:

1. A door assembly (29) comprising:

a frame (31), extending along a frame plane (P1) and comprising at least one frame beam (35) defining a frame axis (X35) along the frame plane, the frame beam comprising a main body (39) elongated along the frame axis and having a substantially constant cross-section (S39) along said frame axis, the main body comprising a beveled portion (55) inclined relative to the frame plane, and a swing door (33), pivotably secured to the frame between an opened position and a closed position, said swing door comprising at least one edge beam (63) comprising a main body (139) elongated along an edge axis (X63) of the edge beam and having a substantially constant cross-section (S139) along said edge axis, the main body comprising a beveled portion (155) which is brought to rest against the beveled portion of the frame beam when the swing door is brought to the closed position, wherein the cross-section (S39) of the main body (39) of the frame beam (35) is identical to the cross-section (S139) of the main body (139) of the edge beam (63);

wherein each main body (39, 139) comprises an outward side portion (41, 141) and an inward side portion (43, 143), the outward side portion and the inward side portion being opposed and parallel, the beveled portion (55, 155) being located between the outward side portion and the inward side portion, the outward side portion (41) and the inward side portion (43) of the frame beam (35) are oriented parallel to the frame plane (P1), and the inward side portion (143) of the edge beam (63) is brought in alignment with the outward side portion of the frame beam and the outward side portion (141) of the edge beam is brought in alignment with the inward side portion of the frame beam, when the swing door (33) is brought to the closed position;

wherein each main body (39, 139) comprises:

an intermediate portion (45, 145), connected to the beveled portion (55, 155) at a junction point (57, 157) of the main body, said intermediate portion extending alongside the inward side portion (43, 143), and a backing portion (51, 151) linking the inward side portion to the intermediate portion;

wherein each main body (39; 139) comprises:

a primary connection portion (54, 154) protruding from the intermediate portion (45, 145) opposite the inward side portion (43, 143), a secondary connection portion (56, 156) protruding from the backing portion (51, 151) opposite the beveled portion (55, 155), and the secondary connection portion has a shape corresponding with the shape of the primary connection portion.

2. The door assembly (29) according to claim 1, wherein the beveled portion (55) of the frame beam (35) is inclined at an angle (β) comprised between 10° and 80°, relative to the frame plane (P1).

3. The door assembly (29) according to claim 1, wherein the door assembly comprise at least one hinge (65) by means of which the swing door (33) is pivotably secured to the frame (31), said hinge comprising a supporting part (67) secured to the inward side portion (43) of the frame beam (35) and a swing part (69) pivotably secured to the supporting part and secured to the swing door (33).

4. The door assembly (29) according to claim 1, wherein:

each main body (39, 139) comprises an outward edging portion (47, 147), extending from an outward side of the beveled portion (55, 155), and an inward edging portion (49, 149), extending from an inward side (57, 157) of the beveled portion parallel to the outward edging portion, the outward edging portion (47) and the inward edging portion (49) of the frame beam (35) are oriented perpendicular to the frame plane (P1), and the inward edging portion (149) of the edge beam (63) is brought parallel and facing to the outward edging portion of the frame beam and the outward edging portion (147) of the edge beam is brought parallel and facing to the inward edging portion of the frame beam, when the swing door (33) is brought to the closed position.

5. The door assembly (29) according to claim 1, wherein the swing door (33) comprises a panel (4J) having an edge, to which the edge beam (63) is secured, the panel including an internal layer (125) of thermal insulating material.

6. The door assembly (29) according to claim 1, wherein the frame (31) is provided with four frame beams (35) arranged as a rectangle, and wherein the swing door (33) is provided with four corresponding edge beams (63) arranged as a corresponding rectangle.

7. An air handling unit, comprising:

a door assembly (29) according to claim 1, at least one insulating panel (4A, 4B, 4C, 4D, 4E, 4F, 4G, 4H), at least one supporting beam (2, 3, 37) to which the frame beam (35) is secured.

8. A method for manufacturing a door assembly (29) according to claim 1, wherein the main body (39) of the frame beam (35) and the main body (139) of the edge beam (63) are made by extrusion, by a common extruder.

9. A door assembly (29) comprising:

a frame (31), extending along a frame plane (P1) and comprising at least one frame beam (35) defining a frame axis (X35) along the frame plane, the frame beam comprising a main body (39) elongated along the frame axis and having a substantially constant cross-section (S39) along said frame axis, the main body comprising a beveled portion (55) inclined relative to the frame plane, and a swing door (33), pivotably secured to the frame between an opened position and a closed position, said swing door comprising at least one edge beam (63) comprising a main body (139) elongated along an edge axis (X63) of the edge beam and having a substantially constant cross-section (S139) along said edge axis, the main body comprising a beveled portion (155) which is brought to rest against the beveled portion of the frame beam when the swing door is brought to the closed position, wherein the cross-section (S39) of the main body (39) of the frame beam (35) is identical to the cross-section (S139) of the main body (139) of the edge beam (63);

wherein each main body (39, 139) comprises an outward side portion (41, 141) and an inward side portion (43, 143), the outward side portion and the inward side portion being opposed and parallel, the beveled portion (55, 155) being located between the outward side portion and the inward side portion, the outward side portion (41) and the inward side portion (43) of the frame beam (35) are oriented parallel to the frame plane (P1), and the inward side portion (143) of the edge beam (63) is brought in alignment with the outward side portion of the frame beam and the outward side portion (141) of the edge beam is brought in alignment with the inward side portion of the frame beam, when the swing door (33) is brought to the closed position;

wherein each main body (39, 139) comprises:

an intermediate portion (45, 145), connected to the beveled portion (55, 155) at a junction point (57, 157) of the main body, said intermediate portion extending alongside the inward side portion (43, 143), and a backing portion (51, 151) linking the inward side portion to the intermediate portion;

wherein the door assembly comprises at least one fastening system (89) engaged through the inward side portion (43) of the frame beam (35) and through the intermediate portion (45) of said frame beam for securing said frame beam to a support (2; 3; 37).

10. A door assembly (29) comprising:

a frame (31), extending along a frame plane (P1) and comprising at least one frame beam (35) defining a frame axis (X35) along the frame plane, the frame beam comprising a main body (39) elongated along the frame axis and having a substantially constant cross-section (S39) along said frame axis, the main body comprising a beveled portion (55) inclined relative to the frame plane, and a swing door (33), pivotably secured to the frame between an opened position and a closed position, said swing door comprising at least one edge beam (63) comprising a main body (139) elongated along an edge axis (X63) of the edge beam and having a substantially constant cross-section (S139) along said edge axis, the main body comprising a beveled portion (155) which is brought to rest against the beveled portion of the frame beam when the swing door is brought to the closed position, wherein the cross-section (S39) of the main body (39) of the frame beam (35) is identical to the cross-section (S139) of the main body (139) of the edge beam (63);

wherein each main body (39, 139) comprises an outward side portion (41, 141) and an inward side portion (43, 143), the outward side portion and the inward side portion being opposed and parallel, the beveled portion (55, 155) being located between the outward side portion and the inward side portion, the outward side portion (41) and the inward side portion (43) of the frame beam (35) are oriented parallel to the frame plane (P1), and the inward side portion (143) of the edge beam (63) is brought in alignment with the outward side portion of the frame beam and the outward side portion (141) of the edge beam is brought in alignment with the inward side portion of the frame beam, when the swing door (33) is brought to the closed position;

wherein each main body (39, 139) comprises:

an intermediate portion (45, 145), connected to the beveled portion (55, 155) at a junction point (57, 157) of the main body, said intermediate portion extending alongside the inward side portion (43, 143), and a backing portion (51, 151) linking the inward side portion to the intermediate portion;

each main body (39, 139) comprises a central portion (53, 153), connected to the beveled portion (55, 155) and the intermediate portion (45, 145) at the junction point (57, 157), said central portion extending perpendicular to said intermediate portion, a first opened cavity (C1) is delimited by the central portion (53) and the intermediate portion, and a second opened cavity (C2) is delimited at least by the beveled portion (55), the second opened cavity being opposite to the first opened cavity relative to the junction point.

11. A door assembly (29) comprising:

a frame (31), extending along a frame plane (P1) and comprising at least one frame beam (35) defining a frame axis (X35) along the frame plane, the frame beam comprising a main body (39) elongated along the frame axis and having a substantially constant cross-section (S39) along said frame axis, the main body comprising a beveled portion (55) inclined relative to the frame plane, and a swing door (33), pivotably secured to the frame between an opened position and a closed position, said swing door comprising at least one edge beam (63) comprising a main body (139) elongated along an edge axis (X63) of the edge beam and having a substantially constant cross-section (S139) along said edge axis, the main body comprising a beveled portion (155) which is brought to rest against the beveled portion of the frame beam when the swing door is brought to the closed position, wherein the cross-section (S39) of the main body (39) of the frame beam (35) is identical to the cross-section (S139) of the main body (139) of the edge beam (63);

wherein each main body (39, 139) comprises an outward side portion (41, 141) and an inward side portion (43, 143), the outward side portion and the inward side portion being opposed and parallel, the beveled portion (55, 155) being located between the outward side portion and the inward side portion, the outward side portion (41) and the inward side portion (43) of the frame beam (35) are oriented parallel to the frame plane (P1), and the inward side portion (143) of the edge beam (63) is brought in alignment with the outward side portion of the frame beam and the outward side portion (141) of the edge beam is brought in alignment with the inward side portion of the frame beam, when the swing door (33) is brought to the closed position;

wherein each main body (39, 139) comprises:

an intermediate portion (45, 145), connected to the beveled portion (55, 155) at a junction point (57, 157) of the main body, said intermediate portion extending alongside the inward side portion (43, 143), and a backing portion (51, 151) linking the inward side portion to the intermediate portion;

wherein the swing door (33) comprises two parallel walls (121, 123), each of said walls being in planar contact with one of the outward and inward side portions (141, 143) of the edge beam (63), each of said walls having an edge flange (191, 193) in planar contact with one of the outward and inward edging portions (147, 149) of said edge beam.

* * * * *